US006173949B1

(12) United States Patent
Visick et al.

(10) Patent No.: US 6,173,949 B1
(45) Date of Patent: Jan. 16, 2001

(54) DEVICE FOR POSITIONING A SHEET STACK FOR STAPLING

(75) Inventors: David S. Visick, Hitchin; John H. Cook, Sherington, both of (GB)

(73) Assignee: Xerox Corporation, Stamford, CT (US)

( * ) Notice: Under 35 U.S.C. 154(b), the term of this patent shall be extended for 0 days.

(21) Appl. No.: 09/145,951

(22) Filed: Sep. 3, 1998

(51) Int. Cl.[7] ..... B65H 33/04

(52) U.S. Cl. ..... 270/58.08; 270/37; 270/58.12; 227/3; 227/119; 227/150

(58) Field of Search ..... 270/37, 58.12, 270/52.08; 227/150, 119, 3, 5, 7

(56) References Cited

U.S. PATENT DOCUMENTS

| | | | |
|---|---|---|---|
| 5,094,379 | 3/1992 | Hoyer et al. | 227/2 |
| 5,595,336 | 1/1997 | Everdyke | 227/7 |
| 5,803,337 * | 9/1998 | Fukai et al. | 227/7 |

FOREIGN PATENT DOCUMENTS

WO 90/08043 7/1990 (WO) .

OTHER PUBLICATIONS

Amal et al., International Publication No. WO 98/33627, Aug. 1998.*

* cited by examiner

*Primary Examiner*—Christopher P. Ellis
*Assistant Examiner*—Richard Ridley

(57) ABSTRACT

In a stapler for variably stapling a set or stack of sheets manually inserted through the stapler entrance path with different orientations, there is a sheet guide system with movable guide members automatically differently repositioned into different sheet guiding positions in the entrance path by the sheet stack insertion and its angle of insertion, including switching in between a corner angled stapling alignment position and a linear sheet edge aligned stapling position, respectively differently positioning the sheet stack for stapling. It may include a base plate, a pair of guide elements movably mounted on the base plate, and a fixed registration wall. The guide members in the corner angled stapling position may present opposing converging 45 degree angled edge registration surfaces to the inserted sheet stack. For edge stapling, the same guide members and/or the registration wall may present one, or two straight edge registration surfaces to the inserted stack. The system is particularly suitable for a simple low cost modification of a powered safety stapler, especially, for a printing or copying machine for stapling its prints or copies.

6 Claims, 5 Drawing Sheets

FIG. 1
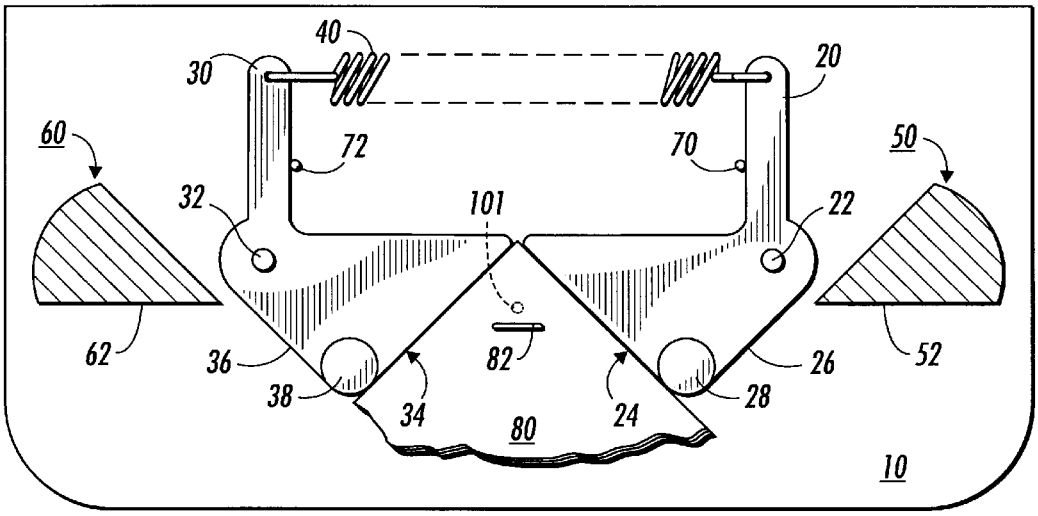
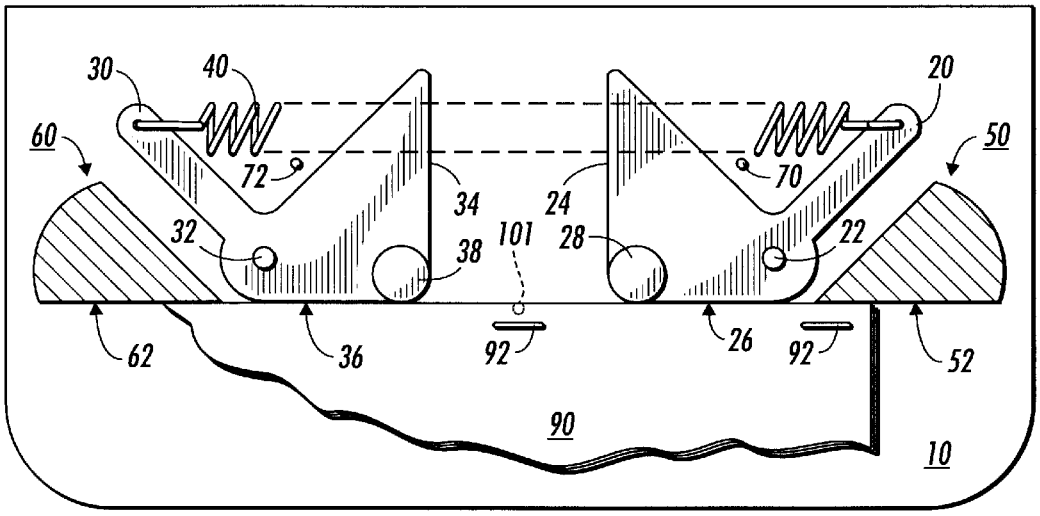
FIG. 2

FIG. 3
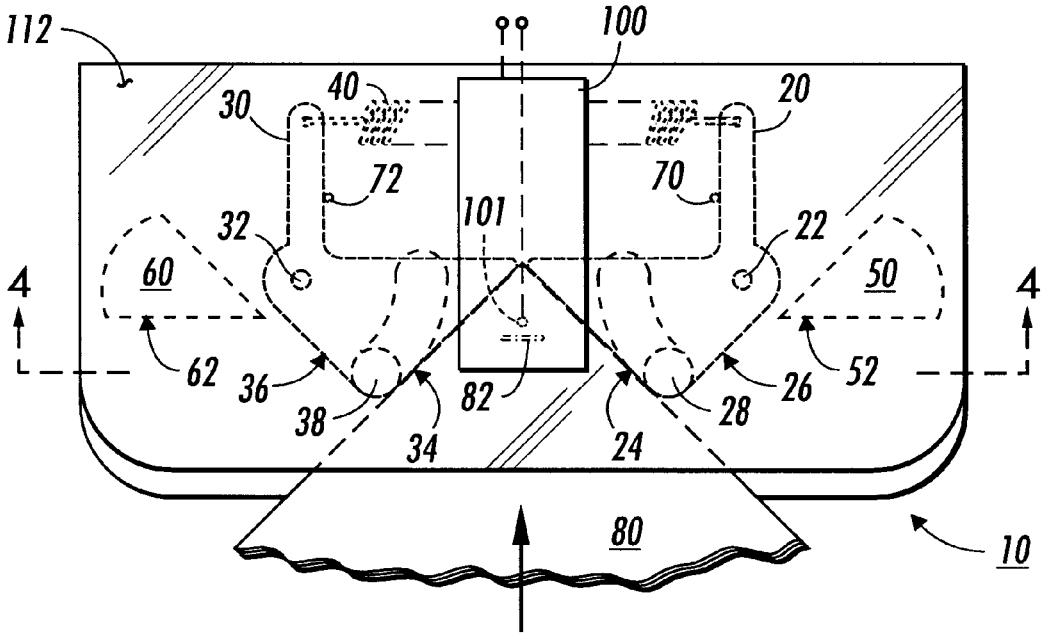
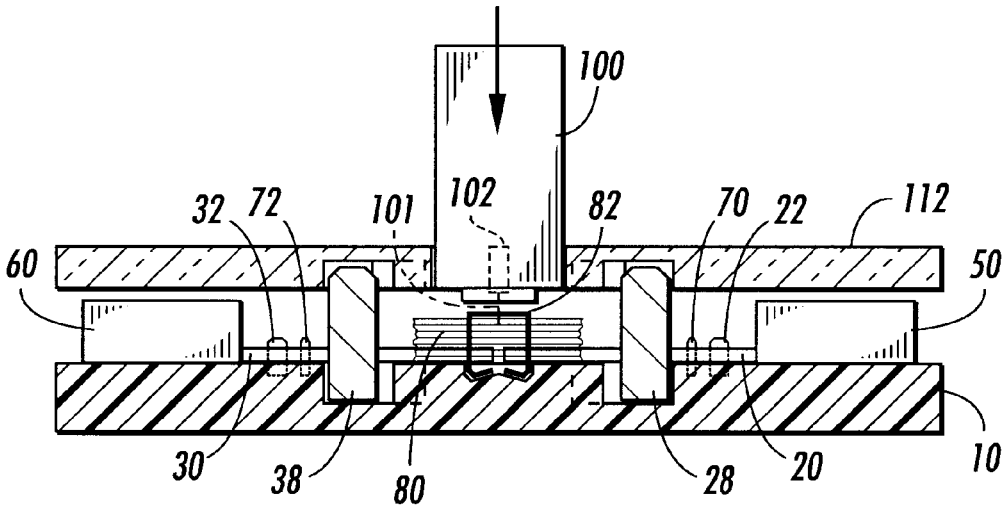
FIG. 4

FIG. 8
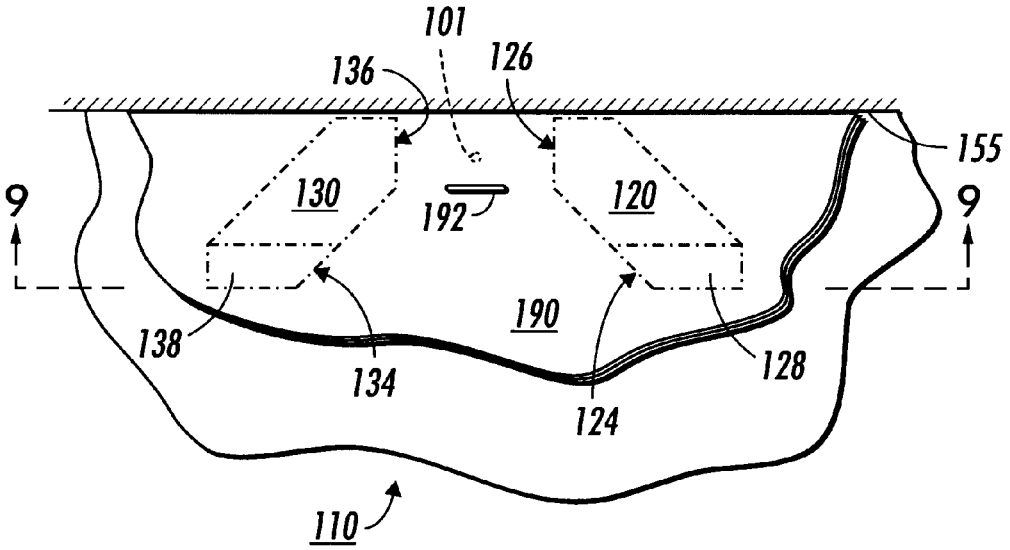
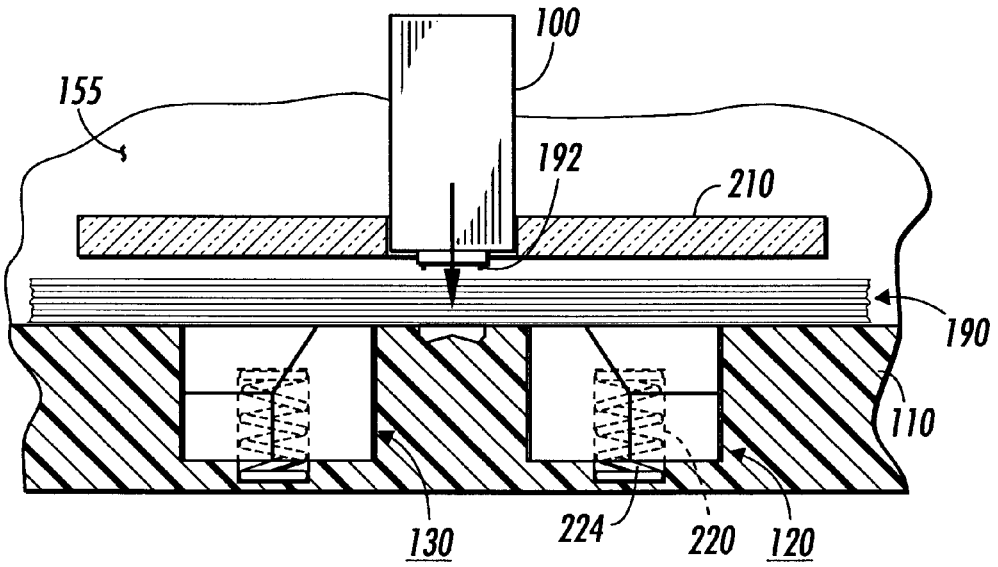
FIG. 9

FIG. 10
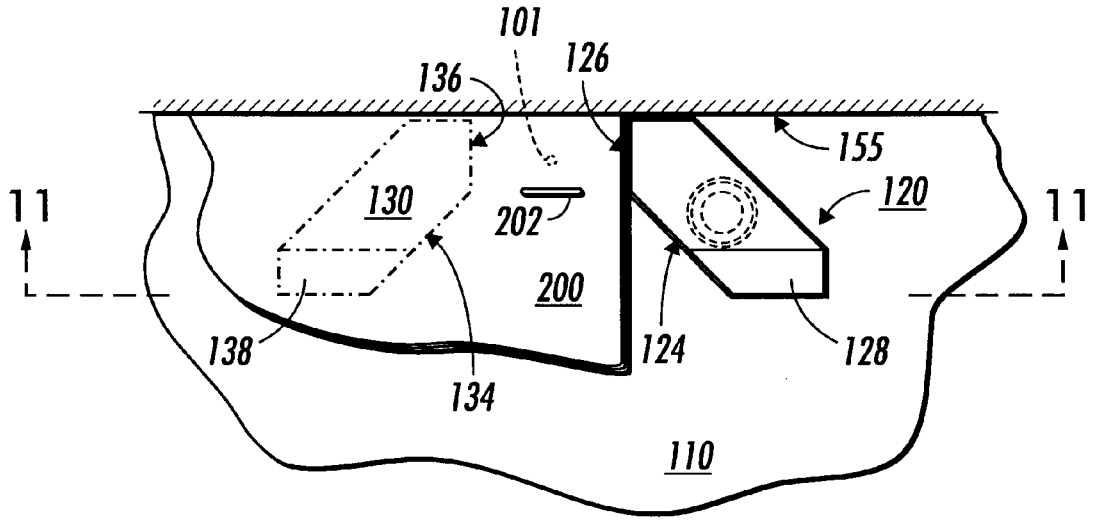
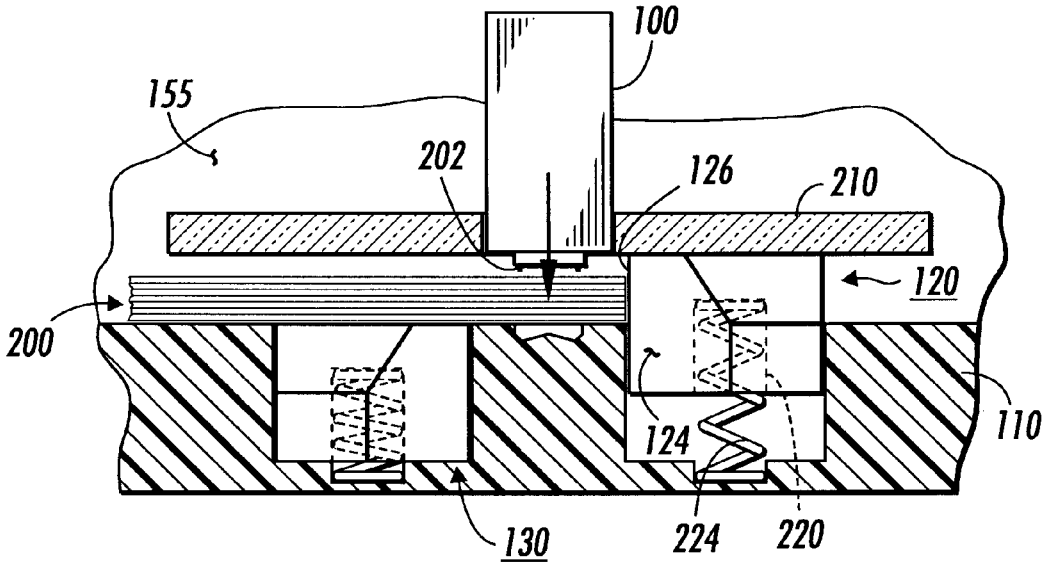
FIG. 11

DEVICE FOR POSITIONING A SHEET STACK FOR STAPLING

This invention generally relates to an improvement in staplers for stapling together a stack of sheets providing improved variable staple positioning with improved registration of the stack of sheets. The disclosed device is particularly suitable for a powered stapler for use in or with a printing or copying machine for stapling its printed or copied sheets output.

The sheet stack positioning device disclosed in the embodiments herein can provide improved assistance to the stapler user in the inserting, locating or positioning of a sheet stack for its stapling, and in particular, in different, defined, stapling positions or orientations of the sheet stack. The embodiments disclose a simple and low cost modification of a stapler which can be provided for or utilised in various different stapling apparatus, powered or manually actuated. It provides improved insertion and staple position control of the sheets to be stapled in a powered stapler, especially those with a restricted safety entrance guide or slot. It can automatically switch in between guided or registered stack corner angled stapling versus guided or registered linear stack edge stapling for single or plural stapling along one stack edge. This disclosed sheet set entrance guide and registration system automatically changes with, and by, the operators insertion of the sheet set itself. The guides or registration members do not need to be reset before stapling to provide different stapling modes.

By way of background, it is often desirable to staple together selected printed or copied sheets from a printing or copying apparatus. Such stapling can be done manually using a separate manual or powered stapling device. However, for convenience many printing or copying machines or their sorter modules include or provide power auxiliary staplers. These are typically operated by inserting an appropriately ordered stack of sheets into a stapling slot a sufficient distance to engage and activate a mechanical finger switch or trigger, which activates the electrical solenoid or motor operation of the stapler. With safety in mind, the access to the stapling slot is typically restricted to prevent accidental insertion, for example, of the operator's fingers. Such restrictive access, operator carelessness, and other difficulties, can interfere with the accuracy of inserting and positioning the set of sheets in relation to the stapler head. For example, the sheets may be inserted too little or too far into the slot, or in an a skewed manner. Stapling in an undesired position or angle, or poorly aligned, miss-registered, shingled, or offset, sheets stapled together can thus result. The typical restricted slot width elongate entrance baffles leading the entering sheet set edge in to the stapler head (provided for safety reasons) can obstruct the operator's view of both the stapling trigger position and the stapling position, often leading to stapling at an undesired angle or at an undesired distance from the edge or edges of the sheet. Even if the upper entrance baffle is transparent or seem-transparent, glare and/or the observation angles involved may make it difficult to properly manually insert the set for power stapling in the correct staple position or angle.

Typical simple manual office staplers do not have such restrictive entrance slots for the sheets, and thus are easier to see the staple driver head and anvil position and thus "eyeball" the stapling position of the sheet set. However, typically manual staplers do not have any sheet set edge registration or alignment guide at all, and require a steady two-handed operation to both hold the set in position and press down hard on the stapler head.

Noted by way of a few examples of patents on the above general subject matter are Xerox Corporation U.S. Pat. No. 5,595,336 issued Jan. 21, 1997 to W. D. Everdyke; and U.S. Pat. No. 5,094,379 issued Mar. 10, 1992 to August Hoyer, and other references cited therein. Those two patents show some examples of powered safety convenience staplers, externally accessible for manual insertion of sets of sheets to be stapled, which may be provided in lieu of or in addition to on-line staplers in copiers or printers.

PCT WIPO Publication No. WO 90/08043 published Jul. 26, 1990, by John Fiske, is cited for a different reason. It was cited in the UK PO search report on UK application No. GB 9710853.4 filed on May 28, 1997 by the common assignee, Xerox Corporation. That U.K application was the parent application of this U.S. application. However, this U.S. application is filed non-convention—not claiming priority from that prior UK application. That UK application was unpublished and ungranted as of the filing date of this U.S. application. WO 90/08043 shows, inter alia, a complex sheet transport system with two different, spaced apart, registration positions for automatic stapling of different sizes of sheets. In contrast, the subject disclosed system relates to simpler, manual sheet insertion, convenience staplers rather than on-line staplers with large, complex and expensive automatic sheet transports, compilers, or the like.

It will be noted that the general problem of positioning of the sheets in relation to the convenience power stapler head has been typically addressed purely by operator "eyeballing", with no effective physical registration, and with stapling occurring wherever the sheets are located whenever the stapler is actuated by the sheets actuating the staplers trigger switch. Or, the stapler may have a single fixed registration edge in the rear of the stapling slot, typically, only perpendicular to the sheet insertion, thus only providing for edge perpendicular stapling. The operator, however, often wants or requires a choice of different sheet stapling positions, in particular, both corner stapling and edge stapling. This choice presents a further registration problem which cannot be solved by the provision of such a single fixed registration means. For example, corner stapling is often desired since it is known that a single 45 degree angled corner staple in the upper left hand corner of the document set is more desirable than a non-angled staple aligned with one sheet edge, since the angled corner staple allows unobstructed page turning and is more resistant to sheet tearing at the staple than an un-angled corner staple.

The disclosed specific embodiments show a stapling device which comprises a base plate, and mounted thereon a pair of movable sheet stack insertion and registration guide elements and a fixed registration wall. The guide elements are movable from a corner stapling position, in which the guide elements in combination present a right angled corner edge registration surface to an inserted sheet stack, to an edge stapling position, in which said registration wall presents a straight edge registration surface to said inserted sheet. This movement of the guide elements between two different positions to provide two different sheet stack registration positions may be accomplished automatically solely by the insertion of the sheet stack itself, depending on its angle of insertion. It may be assisted by a simple light force spring.

To express some of the disclosed features of the embodiments in different words, there is disclosed a sheet stack stapling positioning device for positioning a sheet stack for stapling comprising a pair of pivotally mounted guide elements movable from a first stapling position, in which the guide elements in combination present a right angled edge registration surface to an angularly corner inserted sheet stack for corner stapling thereof, to a second stapling position, in which a straight edge registration surface is presented to a edge inserted sheet stack for edge stapling thereof.

As noted, the disclosed sheet stack stapling positioning device may be utilised integral a reproduction apparatus, or an output finishing module therefor, if desired, but is not limited thereto.

A specific feature of the specific embodiments disclosed herein is to provide in a stapler for stapling a set of plural sheets in a plurality of different staple orientations or positions, in which a set of plural sheets is manually inserted into the stapler for stapling through a stapler entrance path to a stapling position with different manual orientations of the set of plural sheets; the improvement comprising an automatically repositionable sheet guide system which is automatically differently repositioned in said stapler entrance path into plural distinct sheet guiding positions, for differently positioning said set of plural sheets for stapling, in response to said different manual orientations of said set of plural sheets being inserted into said stapler entrance path, said guide system providing guidance of said set of plural sheets being inserted into said stapler entrance path into at least one automatically selected one of said plural distinct sheet guiding positions.

Further specific features disclosed herein, individually or in combination, include those wherein the stapler wherein said plural distinct sheet guiding positions of said automatically repositionable sheet guide system comprise a sheet corner angled sheet guiding and stapling alignment position and a linear sheet edge guiding and stapling alignment position; and/or said automatically repositionable sheet guide system comprises guide means at least part of which are movable by engagement with the leading edges of said set of plural sheets being inserted into said stapler entrance path; and/or said automatically repositionable sheet guide system comprises at least two guide members which are movable by engagement with said set of plural sheets being inserted into said stapler entrance path; and/or said two guide members are pivotally mounted and have guide portions thereof extending within said stapler entrance path to be pivotally moved by engagement with the leading edges of said set of plural sheets being inserted into said stapler entrance path; and/or said pivotal guide members are pivotal from an angular orientation providing a corner angled sheet stapling position into a linear sheet edge stapling position; and/or said pivotal guide members are biased into said corner angled sheet stapling position in the absence of said set of plural sheets being inserted into said stapler entrance path; and/or said automatically repositionable sheet guide system comprises at least one guide member which is movable in and out of said stapler entrance path by engagement with the edges of said set of plural sheets being inserted into said stapler entrance path; and/or said guide member is spring loaded to normally extend into said sheet entrance path in front of said stapling position; and/or said guide member is vertically reciprocally movable and has a bevelled leading edge by which it is pushed down by said set of plural sheets being inserted into said stapler entrance path; and/or in a method of stapling a set of plural sheets in a plurality of different staple orientations or positions, in which a set of plural sheets is manually inserted into the stapler for stapling through a stapler entrance path to a stapling position with different manual orientations of said set of plural sheets; the improvement comprising variably guiding and positioning for stapling said set of plural sheets in said stapler entrance slot by engaging an automatically repositionable sheet guide system with said set of plural sheets as they are being inserted into said stapler entrance slot and automatically differently repositioning said sheet guide system in said stapler entrance path into an automatically selected one of plural distinct sheet guiding positions, for differently positioning said set of plural sheets for stapling, in direct response to said different manual orientations of said set of plural sheets being inserted into said stapler entrance path; and/or said plural distinct sheet guiding positions of said automatically repositionable sheet guide system comprise a sheet corner angled sheet guiding and stapling alignment position and a linear sheet edge guiding and stapling alignment position; and/or a sheet stack positioning device for positioning a sheet stack for stapling comprising:

a base plate;

guide elements movably mounted on said base plate;

and a registration wall fixably mounted relative to said base plate;

wherein said guide elements are movable from a first stapling position, in which said guide elements in combination present a right angled edge registration surface to an inserted sheet stack for corner stapling thereof, to a second stapling position, in which said registration wall presents a straight edge registration surface to said inserted sheet stack for edge stapling thereof; and/or said movement of said guide elements between said first and second stapling positions is responsive to the contact of a sheet stack with said guide elements; and/or tensioning means are provided for urging said guide elements towards said first stapling position; and/or said guide elements are pivotally mounted to said base plate such that they are movable in a direction parallel to the plane defined by the base plate; and/or movement of said guide elements is mechanically coupled to one another; and/or said guide elements are mounted to said base plate such that they are movable in a direction perpendicular to the plane defined by the base plate; and/or said guide elements are positionable in a third stapling position, in which one said guide element in combination with said registration wall presents a right angled edge registration surface to an inserted sheet stack for edge-parallel corner stapling thereof.

As to specific components of the subject apparatus, or alternatives therefor, it will be appreciated that, as is normally the case, some such components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background. What is well known to those skilled in the art need not be described here.

Various of the above-mentioned and further features and advantages will be apparent from the specific apparatus and its operation described in the examples below, and the claims. Thus, the present invention will be better understood from this description of a specific embodiment, including the following drawing figures (approximately to scale, except for the stapler, shown schematically), wherein for drawing clarity in most of the views the upper sheet slot defining entrance baffle plate is not shown:

FIG. 1 is a top or plan view from above of a first embodiment of the invention, shown in a first or corner stapling position;

FIG. 2 is the same plan view from above as FIG. 1 of said first embodiment, but shown in a second or edge stapling position;

FIG. 3 is a top view as in FIG. 1, but showing the upper baffle plate and the stapler (schematically);

FIG. 4 is a front view (viewed from the sheet set insertion position) of the first embodiment of FIGS. 1, 2 and 3;

FIG. 8 is the same plan view from above as FIG. 5 of the second embodiment of FIGS. 5–7, but shown in its second or parallel to the sheet stack edge stapling position;

FIG. 9 is a partially cut away front view (viewed from the sheet set insertion position) of the second embodiment of FIGS. 5–8, showing the upper baffle plate and the stapler, and shown in the second or parallel to the sheet stack edge stapling position of FIG. 8;

FIG. 10 is a plan view from above of the second embodiment of FIGS. 5–9, shown in a third or edge-parallel corner stapling position; and FIG. 11 is a partially cut away front view like FIG. 9 of the second embodiment of FIGS. 5–10, but shown in the third or edge-parallel corner stapling position of FIG. 10.

Figure 5:
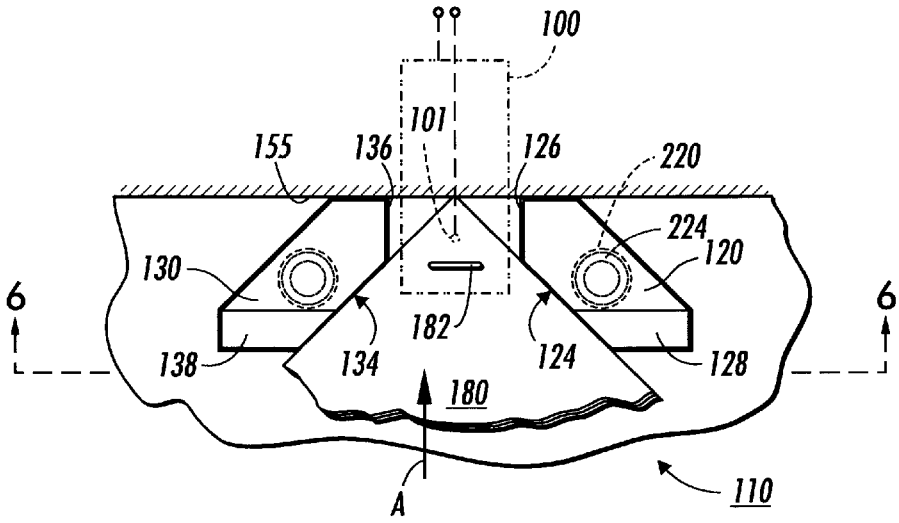
FIG. 5 is a plan view from above of a second embodiment of the invention, shown in its first or corner stapling position.

Disclosed in the FIGS. are two examples of an improvement in staplers. Since it may be incorporated in or utilized in various staplers, including those well known in the art per se, the stapler itself and its operation need not be described in detail herein. The disclosed stapler, like many others, provides for variably stapling a set or stack of sheets manually inserted through the stapler entrance path or slot with different angular orientations. The exemplary improvements described here relate to a sheet guiding and/or sheet stapling positioning system with movable guide members automatically differently repositioned into different sheet guiding positions in the sheet insertion entrance path to the stapling position. This repositioning is by the sheet stack insertion itself, including the sheet stack angle of insertion, including switching by said repositioning in between a corner angled stapling alignment position and a linear sheet edge aligned stapling position, respectively, differently positioning the sheet stack for stapling. As shown, one way in which this system may be implemented includes a base plate, a pair of guide elements or members movably mounted on the base plate or other frame, and a fixed registration wall. The guide members in the corner angled stapling position may present opposing converging 45 degree angled edge registration surfaces to the inserted sheet stack. For edge stapling the same guide members and/or the registration wall may present one, or two, straight edge registration surfaces to the inserted stack instead. The system is particularly suitable for a simple low cost modification of a powered safety stapler, especially for a printing or copying machine for stapling its prints or copies.

It may thus be seen that the disclosed example, in both the first and second embodiments of the FIGS., can comprise a base plate or other mounting element, which may also form the bottom sheet entrance baffle plate or surface; a spaced pair of guide elements movably mounted on said base plate; and a registration wall fixably mounted on or relative to the base plate. The guide elements are movable from a first stapling position, in which the guide elements in combination together present a right angled or corner edge registration surface to an inserted sheet stack for corner stapling thereof, to a second stapling position, in which said registration wall presents a straight edge registration surface to said inserted sheet stack for edge stapling thereof. The movement of said guide elements between said first and second stapling positions is responsive to the insertion of a sheet stack into said device in roughly or approximately the position or angle desired for said first or second stapling positions.

It will be appreciated that said registration wall presenting a straight edge registration surface can alternatively be provided by the upstanding pins, studs, or other elements of the guide members in the second stapling position where there is a simple limit or stop to the further inward movement of the guide members in that position. That is, said registration wall is not necessarily a separate element.

In the first embodiment of FIGS. 1–4, the guide elements are pivotally mounted to the base plate such that they are movable in a direction parallel to the plane defined by the base plate into the second stapling position by engagement of upstanding pins or other parts of the pivotal guide elements which extend across the sheet entrance slot with the leading edge of the entering sheet stack to be stapled. Preferably, the movement of the guide elements is coupled, such as through a connecting spring or other tensioning means attached to both guide elements for spring loading, or otherwise urging, the guide elements towards and into the first stapling position.

In the second embodiment of FIGS. 5–11, the guide elements are mounted to the base plate such that they are movable in a direction perpendicular to the plane defined by the base plate. Thus, if, for example, the base plate defines a horizontal plane, the guide elements in this embodiment are movable up and down on a vertical axis.

In the second embodiment, the guide elements are also shown in FIGS. 10 and 11 to be additionally positionable in a third stapling position, as indicated in its description of those FIGS. above, in which a first guide element in combination with the registration wall presents a right angled or corner edge registration surface to an inserted sheet stack for edge-parallel corner stapling thereof.

Referring now in more detail to the example in FIGS. 1–4 of a first embodiment, the two sheet stack edge guide or registration elements 20 and 30 in this example are pivotally mounted on a base plate 10 by pins 22 and 32, respectively. Each guide element 20, 30 has first 24, 34 and second 26, 36 edges, and a respective projecting pin or stud 28, 38 located adjacent the intersection of the first 24, 34 and second 26, 36 edges. The studs 28, 38 protrude from the guide elements 20, 30 in the direction away from the base plate 10, so as to be in the sheet set entrance path, as particularly shown in FIG. 4. The guide elements 20, 30 are coupled through tension spring 40. Also mounted on the base plate are stops, fingers or wedges 50 and 60 providing respective registration walls 52 and 62 defining a single registration plane perpendicular to the sheet entrance path and parallel to the stapling position and behind (upstream of) the stapling position by a desired fixed distance.

Referring to FIGS. 1, 3, and 4, the first embodiment is shown in the first or corner stapling position. In this position, the spring 40 is lightly tensioned and the guide elements 20, 30 contact stops 70, 72 which may comprise pins or other fixed elements which are integral or fixedly mounted on the base plate 10 in this example. The upstanding pins or studs 28, 38 and/or the first registration edges 24, 34 of the guide elements 20, 30 are seen to form in combination a right angled corner registration edge which accommodates the corner of an angularly inserted paper sheet stack 80. In this first or corner stapling position the two orthogonal sides of the inserted corner of the paper sheet stack 80 respectively abut the two studs 28, 38. This allows and guides the stack 80 to provide proper corner angled and positioned insertion of a staple 82 through the stack 80 by the stapler 100 (shown schematically in FIGS. 3 and 4), when the stapler 100 is actuated by the leading edge of the sheet set 80 interruption of the light beam 101, of a light beam sensor 102, also shown schematically in FIGS. 3 and 4, or a mechanical switch trigger. A time delay is conventionally provided between the time of the initial breaking of light beam 101 by the entering sheets and the time of the stapler 100 operation to allow for the full insertion and the alignment of the sheets before the operation of the stapler. It will also be well understood by those in the stapler art that a passive anvil as shown or an active staple legs clincher is on the opposite side of the sheet entrance slot underneath the stapler staple driving head.

Referring now to FIG. 2, the same first embodiment is shown in its second or linear edge stapling position. In this position, the guide elements 20, 30 have been pivoted about their mounting pins 22, 32 by edgewise insertion of a sheet set 90 against studs 28 and 30, overcoming the tension in the spring 40. The respective second registration edges 26, 36 are now aligned along a single axis, which single axis is shared in this example with the axis defined by the registration walls 52, 62 of the two wedges 50, 60. The two studs 28, 30 and the second registration edges 26, 36 of the guide elements and the registration walls 52, 62 of the wedges 50, 60 are seen in combination form a single registration edge which abuts the edge of the second inserted paper sheet stack 90 to allow to edge-aligned insertion of one or more staples 92. As noted above, the wedges 50, 60 could alternatively even be eliminated, if desired, especially if the stops or detents 70, 72 were positioned to stop the rotation of the guide elements in this registration position, and/or if the edges 26, 36 were high enough up to block the sheet entrance slot along that same line.

Another advantage of the above-described first embodiment is that the automatic repositioning of the two guide members, especially the upstanding guide studs 28, 30, provides a highly visual as well as physical sheet set input and alignment guide which automatically changes between the different desired set input and alignment stapling positions. This is even more pronounced if the top surface of the repositionable guide studs 28, 30 are extending, exposed, up into (as shown in FIG. 4) or through movement slots therefor in the top baffle plate 112 defining the entrance slot. The tops of the studs 28, 30 can even be colored for increased visibility, even if they are enclosed under a semi-transparent un-apertured upper baffle plate. The studs extending up into the upper baffle plate 112 also insure that even a small, e.g., two sheet, set to be stapled does not inadvertently pass between the underside of the top baffle plate 112, the top of the guide members or their studs 28, 30.

Referring now to FIGS. 5–11, there is shown the second embodiment or example, in which guide elements 120, 130 (instead of rotating as in the first embodiment) are mounted on base plate 110 to be reciprocally movable in a direction perpendicular to the plane defined by the base plate 110 (i.e., up or down, in and out of the sheet entrance path). Each guide element 120, 130 has first 124, 134 and second 126, 136 registration edges. Each guide element 120, 130 also has a bevelled or inclined plane front edge portion 128, 138, located in the portion of the guide element 120, 130 which will be first contacted by an inserted stack of sheets. Also mounted on the base plate is a registration wall 155.

Figure 6:
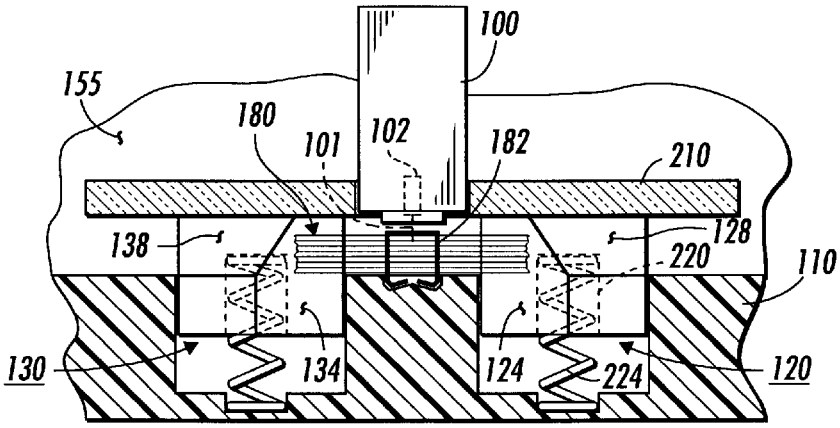
FIG. 6 is a partially cut away front view (viewed from the sheet set insertion position) of the second embodiment of FIG. 5, showing the upper baffle plate and the stapler, and shown in the same first or corner stapling position.

Referring particularly to FIGS. 5 and 6, the second embodiment is shown in the first or corner stapling position. In this position, both guide elements 120, 130 protrude (spring loaded) up from the base, into the sheet insertion slot, where the first registration edges 124, 134, in combination, form a right angled corner registration edge system which accommodates and guides the corner of a first inserted sheet stack 180 for proper corner insertion of a staple 182.

Referring to FIGS. 8 and 9, the same device is now shown in the second or edge stapling position in which both guide elements 120, 130 have been depressed out of the way into the base plate 110 by the inserted sheet stack 190, thereby allowing the edge of the sheet stack 190 to abut and be aligned by the registration wall 155. Edge parallel insertion of one or more staples 192 is thus enabled.

Referring now to FIGS. 10 and 11, the same second device is shown in a third or edge-parallel-corner-stapling position, in which only one guide element 130 is depressed into the base plate 110 by the inserted sheet set 200, thereby allowing a first edge of the sheet stack 200 to abut part of the registration wall 155 of the other, now upstanding, guide element 120. A second, orthogonal, edge of the sheet stack 200 thus abuts the second registration edge 126 of guide element 120, so that in combination a right angled (corner) edge registration surface is presented to the inserted sheet stack 200. Insertion of a staple 202 in the desired edge-parallel corner stapling position may therefore be achieved.

It may be seen that in the second embodiment, the device may be configured such that contact with an inserted sheet stack, depending on its position, can cause one or both of the guide elements 120, 130 to be depressed into the base plate 110 thereby providing for the variety of sheet stapling positions. A mating recess, as shown, or various possible guides may be provided to hold the guide elements 120, 130 in position yet allow their vertical movement.

Figure 7:
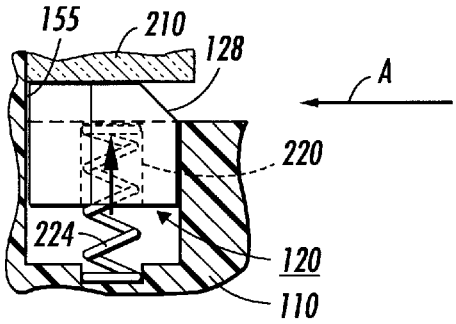
FIG. 7 is a partially cut away side view showing one guide element of the second embodiment of FIGS. 5 and 6 in its raised position mounted within the stapling entrance slot.

Various independent spring mountings of the guide elements 120, 130 may be employed. Referring particularly to FIG. 7, there is shown a side view of single guide element 120 which is lightly spring mounted by an underlying spring 224 positioned within a cavity 220 in the lower part of the guide element 120. In the absence of any external influence, this spring mounting arrangement urges the guide element 120 upwards from the base plate 110 to hold it up against the upper baffle or roof 210 defining the opposite side of the sheet set entrance slot. That is, the base plate 110 and roof 210 in combination form a stapling slot, rear terminating at the registration wall 155. It may be seen that when a sheet stack is inserted into the stapling slot (along axis "A" indicated in FIGS. 5 and 7), the bevelled edge portion 128 of the guide member will be contacted first by the edge of the sheet stack. Further insertion of the sheet stack along axis A thereby causes the guide element 120 to be ramped down or depressed into its recess in the base plate 110. The edge of the still further inserted sheet stack can therefore contact the registration wall 155.

While the embodiments disclosed herein are preferred, it will be appreciated from this teaching that various alternatives, modifications, variations or improvements therein may be made by those skilled in the art, which are intended to be encompassed by the following claims:

We claim:

1. In a stapler for stapling a set of plural sheets in a plurality of different staple orientations or positions, in which a set of plural sheets is manually inserted into the stapler for stapling through a stapler entrance path to a stapling position with different manual orientations of the set of plural sheets; the improvement comprising an automatically repositionable sheet guide system which is automatically differently repositioned in said stapler entrance path into plural distinct sheet guiding positions, for differently positioning said set of plural sheets for stapling, in response to said different manual orientations of said set of plural sheets being inserted into said stapler entrance path, said guide system providing guidance of said set of plural sheets being inserted into said stapler entrance path into at least one automatically selected one of said plural distinct sheet guiding positions;

wherein said automatically repositionable sheet guide system comprises at least two guide members which are movable by engagement with said set of plural sheets being inserted into said stapler entrance path; and wherein said two guide members are pivotally mounted and have guide portions thereof extending within said stapler entrance path to be pivotally moved by engagement with the leading edges of said set of plural sheets being inserted into said stapler entrance path.

2. The stapler of claim 1, wherein said pivotal guide members are pivotal from an angular orientation providing a corner angled sheet stapling position into a linear sheet edge stapling position.

3. The stapler of claim 1, wherein said pivotal guide members are spring loaded to normally extend into said sheet entrance path in front of said stapling position.

4. The stapler of claim 1, wherein movement of said pivotal guide members is mechanically coupled to one another.

5. The stapler of claim 1, wherein a fixed registration wall presents a straight edge registration surface to said inserted set of plural sheets for edge stapling thereof.

6. In a stapler for stapling a set of plural sheets in a plurality of different staple orientations or positions, in which a set of plural sheets is manually inserted into the stapler for stapling through a stapler entrance path to a stapling position with different manual orientations of the set of plural sheets; the improvement comprising an automatically repositionable sheet guide system which is automatically differently repositioned in said stapler entrance path into plural distinct sheet guiding positions, for differently positioning said set of plural sheets for stapling, in response to said different manual orientations of said set of plural sheets being inserted into said stapler entrance path, said guide system providing guidance of said set of plural sheets being inserted into said stapler entrance path into at least one automatically selected one of said plural distinct sheet guiding positions;

wherein said automatically repositionable sheet guide system comprises at least two guide members which are movable by engagement with said set of plural sheets being inserted into said stapler entrance path;

wherein said pivotal guide members are pivotal from an angular orientation providing a corner angled sheet stapling position into a linear sheet edge stapling position; and wherein said pivotal guide members are biased into said corner angled sheet stapling position in the absence of said set of plural sheets being inserted into said stapler entrance path.

* * * * *